US006645262B1

(12) United States Patent
Sanduja et al.

(10) Patent No.: US 6,645,262 B1
(45) Date of Patent: Nov. 11, 2003

(54) LIQUID HYDROCARBON FUEL COMPOSITIONS CONTAINING A STABLE BORIC ACID SUSPENSION

(75) Inventors: Mohan L. Sanduja, Flushing, NY (US); Carl Horowitz, Brooklyn, NY (US); Satyabrata Mukherjee, College Point, NY (US); Paul Thottahil, New Hyde Park, NY (US); William Olliges, Palm City, FL (US); Charles T. Foscue, Westlake Village, CA (US)

(73) Assignee: Advanced Lubrication Technology, Inc., Westlake Village, CA (US)

( * ) Notice: Subject to any disclaimer, the term of this patent is extended or adjusted under 35 U.S.C. 154(b) by 0 days.

(21) Appl. No.: 09/710,043

(22) Filed: Nov. 8, 2000

Related U.S. Application Data

(62) Division of application No. 09/488,423, filed on Jan. 20, 2000.

(51) Int. Cl.[7] ..... C10L 1/12
(52) U.S. Cl. ..... 44/318
(58) Field of Search ..... 44/314, 318

(56) References Cited

U.S. PATENT DOCUMENTS

| | | | | | |
|---|---|---|---|---|---|
| 2,721,121 | A | * | 10/1955 | Laurence et al. | 44/314 |
| 2,809,617 | A | | 10/1957 | Bartleson et al. | |
| 2,835,693 | A | | 5/1958 | Buls et al. | |
| 2,915,543 | A | * | 12/1959 | Groszos | 44/314 |
| 2,927,849 | A | * | 3/1960 | Greblick et al. | 44/314 |
| 2,987,476 | A | | 6/1961 | Hartley et al. | |
| 3,009,797 | A | * | 11/1961 | Dykstra | 44/314 |
| 3,072,699 | A | * | 1/1963 | Ramsden | 44/314 |
| 3,105,747 | A | * | 10/1963 | Calhoun et al. | 44/314 |
| 3,203,773 | A | * | 8/1965 | Landesman | 44/314 |
| 3,220,809 | A | * | 11/1965 | Debize | 44/314 |
| 3,232,903 | A | * | 2/1966 | Schmidle et al. | 260/33.6 |
| 3,297,721 | A | | 1/1967 | Grafstein et al. | |
| 3,405,130 | A | | 10/1968 | Hogsett et al. | |
| 3,497,540 | A | * | 2/1970 | Papetti | 44/314 |
| 3,929,800 | A | * | 12/1975 | Horowitz et al. | 260/290 R |
| 4,016,092 | A | | 4/1977 | Andress | |
| 4,092,127 | A | | 5/1978 | Ryer et al. | |
| 4,184,851 | A | | 1/1980 | Feldman | |
| 4,201,553 | A | | 5/1980 | Osborg | |
| 4,331,545 | A | | 5/1982 | Papay et al. | |
| 4,410,438 | A | * | 10/1983 | Horodysky | |
| 4,440,656 | A | | 4/1984 | Horodysky | |
| 4,505,725 | A | | 3/1985 | Schuettenberg | |
| RE32,246 | E | * | 9/1986 | Horodysky | |
| 4,788,340 | A | | 11/1988 | Horodysky | |
| 4,801,390 | A | | 1/1989 | Robson | |
| 4,965,003 | A | | 10/1990 | Schlicht | |
| 5,090,966 | A | * | 2/1992 | Crawford et al. | 44/314 |
| 5,197,996 | A | | 3/1993 | Reid et al. | |
| 5,217,632 | A | | 6/1993 | Sharif | |
| 5,229,295 | A | | 7/1993 | Travis | |
| 5,240,624 | A | | 8/1993 | Koch | |
| 5,314,510 | A | * | 5/1994 | Hammer et al. | 44/317 |
| 5,430,105 | A | | 7/1995 | Redpath et al. | |
| 5,431,830 | A | * | 7/1995 | Erdemir | 44/314 |
| 5,522,906 | A | | 6/1996 | Hashimoto et al. | |

FOREIGN PATENT DOCUMENTS

| | | |
|---|---|---|
| EP | 0081954 | 6/1983 |
| EP | 0350165 | 1/1990 |
| GB | 778822 | 7/1957 |
| GB | 818047 | 8/1959 |

OTHER PUBLICATIONS

Vol. 48, No. 1, Jan./Feb., 1996 p. 10–14, Wilson, "Fuel Lubricity" Industrial Lubrication and Tribology.*
International Search Report from PCT, dated Jul. 11, 2001.

* cited by examiner

*Primary Examiner*—Margaret Medley
(74) *Attorney, Agent, or Firm*—Sonnenschein Nath & Rosenthal

(57) ABSTRACT

Disclosed are liquid hydrocarbon fuel concentrates, including low sulfur liquid hydrocarbon fuel concentrates containing at least 5,000 ppm boric acid suspended in the liquid hydrocarbon fuel. The liquid hydrocarbon fuels include gasoline, diesel fuel, aviation fuel, jet fuel, boat or motorcycle fuel. Also disclosed are liquid hydrocarbon fuels compositions formed by diluting the concentrate to form compositions containing only from about 10 ppm to about 50,000 ppm boric acid. Also disclosed are liquid hydrocarbon fuel compositions formed of a reaction product of boric acid having a particle size of about 65 microns or less, associated with a liquid hydrocarbon fuel having a monomer or prepolymer chemically grafted thereon.

5 Claims, No Drawings

LIQUID HYDROCARBON FUEL COMPOSITIONS CONTAINING A STABLE BORIC ACID SUSPENSION

This patent application is a divisional patent application of Ser. No. 09/488,423, filed Jan. 20, 2000 and now pending.

BACKGROUND OF THE INVENTION

1. Field of the Invention

This invention relates to the chemical arts. In particular, it relates to liquid hydrocarbon fuel compositions, such as low-sulfur diesel and low-sulfur gasoline fuel compositions.

2. Discussion of the Related Art

Liquid hydrocarbon fuels typically contain up to as much as 40,000 ppm sulfur. The sulfur imparts several desirable properties to the fuels. For example, sulfur provides high lubricity in rolling, rotating, or sliding engine parts such as piston rings and liners, fuel pumps, and injector systems. However, sulfur suffers from serious disadvantages. It causes environmental problems in the form of high levels of sulfur dioxide ($SO_2$) and hazardous particulates in engine exhaust gases. Because of high $SO_2$ particulate and emissions, diesel-powered engines are not widely used or permitted in many large cities.

Consequently, there has been a longstanding need to develop low-sulfur hydrocarbon fuel compositions. For example, low-sulfur No. 2 diesel fuel currently contains about 500 ppm sulfur and numerous attempts are being made to further reduce the sulfur content to about 300 ppm sulfur or less. Unfortunately, removing the sulfur reduces the lubricating capacity of the diesel fuel, accelerating wear in fuel system and combustion chamber components. When sulfur is eliminated from fuels, high friction and wear occur on sliding surfaces of fuel-delivery systems and cause catastrophic failure.

Boric acid is environmentally safe, inexpensive, and has an unusual capacity to enhance the antifriction and antiwear properties of sliding metal surfaces. U.S. Pat. No. 5,431,830, to Erdemir, describes adding boric acid to greases, oils, and the like to improve lubricity. The patent suggests that the particles of boric acid, under high pressure and frictional traction, interact with the load-bearing surfaces to provide excellent resilience and load carrying capacity. The layer structure of crystalline boric acid particles can slide over each other with relative ease and can reduce friction and wear.

Boric acid is a crystalline compound, insoluble in hydrocarbons such as greases and oils. Because of the viscous nature of greases and oils, the Erdemir patent teaches that boric acid can be dispersed in the greases and oils simply by using conventional equipment and techniques. This patent also describes solid polymers having boric acid incorporated in the polymeric structure. This patent does not suggest that boric acid can be added to improve the performance of low-sulfur hydrocarbon fuels. Nor does the patent suggest a method for preparing stable suspensions of boric acid in liquid hydrocarbon fuels or any other such low-viscosity hydrocarbon media.

U.S. Pat. No. 3,929,800, to Horowitz, describes a process for simultaneously polymerizing and grafting monomers onto liquid hydrocarbons, to improve various properties including viscosity. Among the liquid hydrocarbons disclosed in the Horowitz patent are post pyrolytic gasoline and catalytic cracking fractions. The patent does not suggest adding boric acid to the liquid hydrocarbons or modifying the process to form stable suspensions of particulate boric acid in such hydrocarbons.

Accordingly, there remains a great need for liquid hydrocarbon fuel compositions that provide high lubricity and low wear in various engine components, such as fuel pumps and injector systems, a clean environment (resulting from the use of low-sulfur fuels), and low cost. There is a further need for stable suspensions containing particulate boric acid in liquid hydrocarbon fuel compositions. The invention meets these needs and provides related advantages as well.

SUMMARY OF THE INVENTION

Now in accordance with the invention there have been found liquid hydrocarbon fuel concentrates containing from about 50,000 ppm to about 250,000 ppm particulate boric acid, based on the total weight of the concentrate, suspended in a liquid hydrocarbon fuel. The liquid hydrocarbon fuels include gasoline, diesel fuel, aviation fuel, jet fuel, boat or motorcycle fuel. In some embodiments the liquid hydrocarbon fuel contains less than 500 ppm or less than 300 ppm sulfur or even substantially no sulfur. In some embodiments, the boric acid has a particle size of about 65 microns or less, preferably, in the range of from about 0.1 to about 2.5 microns or from about 0.5 to about 1 micron. In some embodiments, the concentrate is diluted to form a finished liquid hydrocarbon fuel containing only from about 10 ppm to about 50,000 ppm boric acid, preferably about 30 ppm to about 5,000 ppm, boric acid based on the total weight of the finished fuel, suspended in the fuel composition.

Also in accordance with the invention, there have been found liquid hydrocarbon fuel compositions formed of a reaction product of boric acid having a particle size of about 65 microns or less, preferably, in the range of from about 0.1 to about 2.5 microns, and in some embodiments from about 0.5 to about 1 micron, associated with a liquid hydrocarbon fuel having a monomer or prepolymer chemically grafted thereon. The liquid hydrocarbon fuels include gasoline, diesel fuel, aviation fuel, jet fuel, boat or motorcycle fuel and in some embodiments contains less than 500 ppm, or less than 300 ppm or even substantially no sulfur.

In some embodiments, the monomer or prepolymer is a silane monomer or prepolymer. And in some embodiments, the liquid hydrocarbon fuel composition additionally contains from about 200 ppm to about 600 ppm surfactant, based on the weight of the fuel concentrate and from about 2 ppm to about 6 ppm surfactant, based on the weight of the finished fuel.

The finished liquid hydrocarbon fuel when combusted in an internal combustion engine provides superior lubricity and reduced engine wear, causes less hazardous particulates and gases to be emitted, prevents corrosion, and provides a certain degree of increased fuel economy. Additionally, the boric acid remains suspended in both the concentrate and the finished inventive fuel compositions providing a shelf-life of one to two years.

DETAILED DESCRIPTION OF THE PREFERRED EMBODIMENTS

Boric acid is advantageously added to any liquid hydrocarbon fuel for use in an internal combustion engine such as gasoline, diesel fuel, aviation fuel, jet fuel, boat or motorcycle fuel and, in particular, it is advantageously added to low-sulfur liquid hydrocarbon fuels. Low sulfur liquid hydrocarbon fuel are fuels containing less than 40,000 ppm sulfur. It is an advantage of the liquid hydrocarbon fuels in accordance with the invention that they can contain less than 500 ppm or less than 300 ppm or even substantially no sulfur.

Boric acid useful in accordance with the invention is advantageously produced by the low temperature jet-milling of commercially available boric acid. The conditions of the low temperature jet-milling process can be adjusted to produce boric acid particles having particle size of 65 microns or less, as desired. In preferred embodiments, the boric acid has a particle size in the range of from about 0.1 to about 2.5 microns, preferably in the range of from about 0.5 to about 1 micron.

It is most efficient to initially prepare a concentrated suspension of the boric acid in the liquid hydrocarbon fuel. The concentrate preferably contains from about 50,000 ppm and preferably up to about 250,000 ppm particulate boric acid, based on the weight of the suspension.

The concentrate can then be diluted with additional liquid hydrocarbon fuel to obtain the final desired concentration. The concentration of boric acid in the finished fuel composition will depend on the particular fuel and the particular engine system. Typically, however, the final boric acid concentration will be in the range of from about 10 ppm to about 50,000 ppm and more preferably in the range of from about 30 ppm to about 5,000 ppm, based on the weight of the liquid hydrocarbon fuel composition. For example, the particulate boric acid concentration in no. 2 diesel fuel is in the range of from about 50 ppm to about 25,000 ppm and more preferably in the range of from about 100 ppm to about 1500 ppm, based on the weight of the finished liquid hydrocarbon fuel composition.

The liquid hydrocarbon fuel compositions can contain other conventional fuel additives. Representative additives include antioxidants, metal passivators, rust inhibitors, dispersants, detergents, and the like. The liquid hydrocarbon fuel compositions also can contain additional lubricity-enhancing agents, such as stearic acid.

The boric acid is stabilized by forming a reaction product with chemically grafted liquid hydrocarbon fuel. Without wishing to be bound by a theory of the invention, it is believed that boric acid's hydroxyl groups can become loosely associated with liquid hydrocarbon fuel. However, when suitable monomers or prepolymers are chemically grafted onto the liquid hydrocarbon fuel, the resulting polymer chains effectively stabilize the boric acid-liquid hydrocarbon fuel association and create a stable reaction product, effectively suspending the boric acid particles in the liquid hydrocarbon fuel.

Any polymerizable monomer or prepolymer can be chemically grafted onto the liquid hydrocarbon fuel, so long as it does not adversely effect the properties of the fuel. Suitable monomers include methyl methacrylate (also oleyl, alpha-decyl, octadecyl, cyclohexyl, n-butyl, amyl, cetyl acrylates and others), acrylic acid and its derivatives (also butyl, amyl, octyl hexadecyl etc.), methylacrylate vinyl acetate, vinyl chloride, vinylidene chloride, isobutylene, vinyl ethers, acrylonitrile, maleic acid and esters, crotonic acid and esters, itaconic acid and its esters, allylic esters, allyl vinyl esters, vinlypyridine and its derivatives (also 2-methyl-5-vinyl pyridine), bisbetachloro ethylvinyl phosphonate, chloroprene, isoprene, dimethylaminethyl, methacrylate, styrene, 1,3-butylene dimethacrylate, isooctyl vinyl ether, acrylamide, glycidyl methacrylate, N-vinyl caprolactam, N-vinyl pyrrolidone, N-vinyl carbazole, sodium styrene sulfonate, sodium vinyl sulfonate, bis (betachloroethyl) vinyl phosphonate, cetyl vinyl ether, divinylether of ethylene glycol, divinyl ether of butanediol, vinyl toluene, vinyl acetate, octadecyl vinylether.

Other suitable monomers include mono-, di-, tri-, tetra-, and poly-ethene glycoldimethacrylate, methylvinylpyridine, allylacrylate and methacrylate, allylchloride, allyl alcohol, perfluoro alkyl acrylates and methacrylates, p-aminostyrene, vinyl bromide and vinylidene bromide trimethylvinylbenzylammonium chloride, vinyltrifluoroacetate (followed by hydrolysis to poly-vinyl alcohol), diallyl chloromethyl phosphonate, diallyl benzene phosphonate, diallyl dimethyl ammonium chloride, diallyl diethyl ammonium bromide, glycidyl acrylate and methacrylate, ethylene glycol, diethyleneglycol, an polyethylene glycol acrylates and methacrylates, vinyl perfluoro octaneate, and the like.

The monomeric tertiary amines can be quaternized with benzyl chloride, ethyl iodide, methyl or ethylsulfate. Conversely, monomeric chlorides can be quaternized with tertiary amines to give quaternary ammonium compounds. Some suitable tertiary amines are: N-ethyl morpholine, pyridine, cetyldimethyl pryidine, dimethyl aniline, and the like. Also mixtures of two or more monomers can be used.

If the monomer is not soluble in the liquid hydrocarbon fuel, the monomer can be dissolved in a solvent, before adding the monomer to the liquid hydrocarbon fuel. Suitable solvents include dimethylformamide, tetrahydrofurane, tetrahydrofurfuryl alcohol, dimethylsulfoxide, water, methyl, ethyl or isopropyl alcohol, acetone, methyl ethyl ketone and acetate or mixtures of two or more of the solvents.

The preferred monomers/prepolymers are silane monomers/prepolymers, such as silicones and other related prepolymers, having siloxy functional groups for complexing with the boric acid. Suitable silane monomers/prepolymers include Dow Coming 174 silane monomer and Dow Coming 1248 silicone prepolymer. Chemically grafting silicone polymer chains to the liquid hydrocarbon fuel is particularly effective because the silicone chains double as surfactants. Polar sites on the polymer chains form bridges between the boric acid and the liquid hydrocarbon fuel thus stabilizing the interaction between the two.

The boric acid-chemically grafted liquid hydrocarbon fuel reaction product is prepared by first adding one or more surfactants to a liquid monomer or prepolymer. Suitable surfactants include dispersants such as glucose ether, sulphonated castor, and salts of calcium and zinc. Especially useful are Ircosperse 2174 alkyl aminoester, Ircosperse 2176 alkenylsuccinic anhydride, and Ircogel 905 calcium sulfonate, all available from Lubrizol, Inc., Witcliffe, Ohio. Sufficient surfactants are used so that when the particulate boric acid is added to the monomer/prepolymer/surfactant mixture, the macro globule particles of the boric acid are broken up and prevented from reforming. Typically, from about 2 ppm to about 6 ppm surfactant, preferably from about 2.5 ppm to about 4.5 ppm surfactant, are added, based on the weight of the reaction product, when the concentrations of the ingredients are chosen, so that the concentrated boric acid suspension is produced.

After adding the boric acid, the liquid hydrocarbon fuel is added and the resulting mixture stirred vigorously until it is homogeneous. Typically, sufficient hydrocarbon fuel is added so that the concentration of boric acid after reaction is from about 50,000 ppm to about 250,000 ppm, although greater or lesser amounts of liquid hydrocarbon fuel can be added if desired.

In those embodiments where a combination of monomers and/or prepolymers are used, additional surfactant, such as Ircogel 905, Ircosperse 2174, and or Dow Corning 57 silicone glycol surfactant are included along with the liquid hydrocarbon fuel. The additional surfactant facilitates the contact between the different monomers/prepolymers. The additional surfactant also helps to adjust the rheology of the composition, enhancing the association between the boric acid and the chemically grafted liquid hydrocarbon fuel, thereby adding to the stability of the suspension.

Catalyst, additional monomer, and the other additional ingredients are added either before, during, or after the addition of the liquid hydrocarbon fuel. Among the catalysts that can be used are ammonium persulfate, hydrogen peroxide, tert-butylhydroperoxide, ditert-butyl peroxide, benzoyl peroxide, dicumyl peroxide, lauroyl peroxide, tert-butyl perbenzoate, methylethlylketone peroxide, and peracetic acid.

The concentration of the monomer in the reaction solution can vary within practically any limits, for example, from between about 1,000 ppm to 500,000 ppm. However, the preferred concentration for facility of use is between about 10,000 ppm and about 200,000 ppm, based on the weight of the solution.

Finally, a graft initiator, such as ferrous sulphate or a silver salt, is added. Suitable silver salts include silver nitrate, silver acetate, silver sulfate, silver carbonate, and silver perchlorate. Silver perchlorate is a preferred graft initiator, since it is soluble in liquid hydrocarbon fuel, such as diesel fuel.

The concentration of the graft initiator can vary within a wide range, though it is preferably between about 0.0001 to about 0.01 percent. An amount of about 0.001 percent or lower is preferable for reasons of economy.

The mixture is then allowed to react while stirred at ambient temperature and pressure until a concentrated suspension containing the boric acid-chemically grafted liquid hydrocarbon fuel is formed. Using this method it is possible to prepare a concentrated boric acid suspension in liquid hydrocarbon fuels having a sulfur content of less than 40,000 ppm, such as liquid hydrocarbon fuels having a sulfur content of less than 500 ppm, or less than 300 ppm sulfur or even no sulfur at all. Further it is possible to dilute the concentrate to form a finished liquid hydrocarbon fuel containing from about 10 ppm to about 50,000 ppm and more preferably in the range of from about 30 ppm to about 5,000 ppm particulate boric acid, based on the weight of the finished liquid hydrocarbon fuel. The concentration of surfactant in the finished hydrocarbon fuel is preferably from about 2 ppm to about 6 ppm. Both the concentrate and the finished fuel remain stable, even when subjected to a variety of potentially destabilizing conditions. For example, the boric acid remains suspended at temperatures ranging from about to about −30° F. to 150° F. and is shelf stable for one to two years. Moreover, the finished liquid hydrocarbon fuel compositions when combusted in an internal combustion engine provides superior lubricity and reduced wear on the components of the internal combustion engine, while preventing corrosion, and providing a certain degree of increased fuel economy. In addition, the finished compositions when combusted in an internal combustion engine reduce hazardous particulate and gaseous (i.e., sulfur dioxide, carbon dioxide) emissions as compared to traditional liquid hydrocarbon fuels.

The foregoing examples are intended to further illustrate the invention and are not limitations thereon. All percentages are amounts are based on weight, unless otherwise clearly indicated.

EXAMPLE 1

This example illustrates the preparation of a suspension of 17 wt. % boric acid in a low sulfur diesel fuel.

Eight and one-half parts Dow Coming 1248 silicone prepolymer is added to a reaction vessel, followed by the addition of 1.75 parts Ircosperse 2176 alkenylsuccinic anhydride, 2.30 parts Ircogel 905 calcium sulfonate, 1.77 parts Ircosperse 2174 alkyl aminoester, and 1.91 parts stearic acid, while stirring. Next is added 17.00 parts boric acid having an average particle size of one to two microns. The mixture is vigorously stirred for thirty minutes at 2000 RPM using a high speed stirrer.

The following ingredients are then added in the amount and in the order indicated:

| Ingredient | Parts by Weight |
|---|---|
| Lubersol DDM-9 1% methylethylketone peroxide in plasticizer | 0.01 |
| Silane A-174 | 0.40 |
| Dow Corning 57 silicone glycol surfactant | 0.10 |
| Diesel Fuel (300 ppm Sulfur) | 66.25 |
| 0.1% Silver perchlorate in diesel fuel | 0.01 |

After addition of the silver perchlorate solution the mixture is stirred for thirty minutes. There results a stable suspension containing 17 wt. % boric acid in the low-sulfur diesel fuel.

EXAMPLE 2

This example illustrates the preparation of a liquid hydrocarbon fuel containing 10 ppm particulate boric acid from a concentrate.

Five parts Dow Coming 1248 silicone prepolymer (based on 1,000,000 parts) are added to a five gallon reaction vessel, followed by the addition of 0.3325 parts Dow Coming 57 silicone glycol surfactant, Ircosperse 2176 alkenylsuccinic anhydride, 0.3325 parts and 2.4475 parts diesel fuel. Then 10 parts boric acid are slowly added to the other ingredients in the reaction vessel and a homogeneous slurry formed.

A mixture is made by dissolving 0.5 parts stearic acid in 5 parts diesel fuel heated to 80° F. and then adding 0.665 parts Dow Corning 57 silicone glycol surfactant, and 0.665 parts Ircosperse 2174 alkyl amino ester. This mixture is added to the slurry, after the slurry is stirred for ten minutes with a high speed stirrer. 0.0025 Lubersol DDM-9 1% methylethylketone peroxide in plasticizer, 0.05 parts Silane A-174, and 0.0025 0.1% silver perchlorate in diesel fuel are then added to the slurry and a reaction product formed.

A second mixture is made by dissolving 2 parts stearic acid in 10 parts heated diesel fuel and then adding 2 parts Ircogel 905 calcium sulfonate, 2 parts Ircosperse 2174 alkyl amino ester, and 2 parts Ircosperse 2176 alkenylsuccinic anhydride. This mixture is then added to the other ingredients after the reaction product is cooled to ambient temperature and allowed to sit for twenty-four hours.

Next, an additional 30 ppm is heated to 80° F. and added, while stirring to form a concentrated suspension containing 17,000 ppm boric acid. A stable finished diesel fuel containing 10 ppm boric acid is then prepared by adding an additional 999927.00025 parts diesel fuel.

What is claimed is:

1. A liquid hydrocarbon fuel concentrate comprising a liquid hydrocarbon fuel and at least 50,000 ppm boric acid having a particle size in the range of from about 0.1 to about 2.5 microns, based on the total weight of the liquid hydrocarbon fuel concentrate, suspended in the liquid hydrocarbon fuel.

2. A liquid hydrocarbon fuel concentrate comprising a liquid hydrocarbon fuel and at least 50,000 ppm boric acid having a particle size in the range of from about 0.5 to about 1 micron, based on the total weight of the liquid hydrocarbon fuel concentrate, suspended in the liquid hydrocarbon fuel.

3. A low-sulfur liquid hydrocarbon fuel concentrate comprising a diesel fuel having a sulfur content of less than 500 ppm, based on the weight of the fuel concentrate, and from about 5,000 ppm to about 25,000 ppm boric acid having a particle size of about 65 microns or less, based on the total weight of the fuel concentrate, suspended in the diesel fuel.

4. A low-sulfur liquid hydrocarbon fuel concentrate comprising a gasoline or diesel fuel having a sulfur content of less than 500 ppm, based on the weight of the fuel concentrate, and from about 5,000 ppm to about 25,000 ppm boric acid having a particle size of from about 0.5 to about 1 micron, based on the total weight of the fuel concentrate suspended in the gasoline or diesel fuel.

5. A low-sulfur liquid hydrocarbon fuel composition comprising a gasoline or diesel fuel having a sulfur content of less than 500 ppm, based on the weight of the fuel composition and;

from about 30 ppm to about 5,000 ppm boric acid having a particle size of about 65 microns or less based on the total weight of the fuel composition, suspended in the fuel composition.

* * * * *